US006540592B1

(12) United States Patent
Schultz et al.

(10) Patent No.: US 6,540,592 B1
(45) Date of Patent: Apr. 1, 2003

(54) CARRIER HEAD WITH REDUCED MOMENT WEAR RING

(75) Inventors: Stephen C. Schultz, Gilbert, AZ (US); John D. Herb, Phoenix, AZ (US); Timothy S. Dyer, Tempe, AZ (US)

(73) Assignee: Speedfam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/716,784

(22) Filed: Nov. 20, 2000

Related U.S. Application Data

(60) Provisional application No. 60/214,905, filed on Jun. 29, 2000.

(51) Int. Cl.[7] ..... B24B 29/00

(52) U.S. Cl. ..... 451/285; 451/288; 451/398

(58) Field of Search ..... 451/285, 286, 451/287, 288, 289, 397, 398, 41, 385, 384, 388

(56) References Cited

U.S. PATENT DOCUMENTS

| | | | | |
|---|---|---|---|---|
| 5,205,082 A | | 4/1993 | Shendon et al. | |
| 5,377,451 A | * | 1/1995 | Leoni et al. | 451/287 |
| 5,571,044 A | | 11/1996 | Bolandi et al. | |
| 5,584,746 A | | 12/1996 | Tanaka et al. | |
| 5,584,751 A | | 12/1996 | Kobayashi et al. | |
| 5,624,299 A | | 4/1997 | Shendon | |
| 5,681,215 A | | 10/1997 | Sherwood et al. | |
| 5,851,140 A | * | 12/1998 | Barns et al. | 451/288 |
| 5,899,798 A | * | 5/1999 | Trojan et al. | 451/398 |
| 5,941,758 A | * | 8/1999 | Mack | 451/287 |
| 5,964,653 A | | 10/1999 | Perlov et al. | |
| 6,056,632 A | * | 5/2000 | Mitchel et al. | 451/288 |
| 6,080,050 A | * | 6/2000 | Chen et al. | 451/288 |
| 6,116,990 A | * | 9/2000 | Sinclair et al. | 451/398 |

FOREIGN PATENT DOCUMENTS

| | | |
|---|---|---|
| EP | 0 786 310 A1 | 7/1997 |
| EP | 0 841 123 A1 | 6/1998 |
| EP | 0 947 288 A2 | 10/1999 |
| JP | 5-69310 | 3/1993 |

* cited by examiner

*Primary Examiner*—Eileen P. Morgan
*Assistant Examiner*—Hadi Shakeri
(74) *Attorney, Agent, or Firm*—Ingrassia Fisher & Lorenz, P.C.

(57) ABSTRACT

A work piece carrier head for a CMP or other polishing apparatus is configured to eliminate the slow band associated with the polishing of the surface of a work piece. The carrier head includes a wear ring that is positioned circumferentially about the work piece and that together with the work piece is pressed against a moving polishing pad. The wear ring is resiliently coupled to the body of the carrier head in a manner to avoid any overturning moment on the ring caused by the frictional force of the polishing pad against the wear ring.

24 Claims, 12 Drawing Sheets

CARRIER HEAD WITH REDUCED MOMENT WEAR RING

This application claims the benefit of provisional application No. 60/214,905, filed Jun. 29, 2000.

FIELD OF THE INVENTION

This invention relates generally to a work piece carrier head for a polishing apparatus, and more specifically to a carrier head having a circumferential wear ring mounted to have a near zero overturning moment.

BACKGROUND OF THE INVENTION

The manufacture of many types of work pieces requires the substantial planarization of at least one surface of the work piece. Examples of such work pieces that require a planar surface include semiconductor wafers, optical blanks, memory disks, and the like. Without loss of generality, but for ease of description and understanding, the following description of the invention will focus on applications to only one specific type of work piece, namely a semiconductor wafer. The invention, however, is not to be interpreted as being applicable only to semiconductor wafers. Those of skill in the art instead will recognize that the invention can be applied to any generally disk shaped work pieces.

One commonly used technique for planarizing the surface of a work piece is the chemical mechanical planarization (CMP) process. In the CMP process a work piece, held by a work piece carrier head, is pressed against a moving polishing pad in the presence of a polishing slurry. The mechanical abrasion of the surface combined with the chemical interaction of the slurry with the material on the work piece surface ideally produces a planar surface.

The construction of the carrier head and the relative motion between the polishing pad and the carrier head have been extensively engineered in an attempt to achieve a uniform removal of material across the surface of the work piece and hence to achieve the desired planar surface. For example, the carrier head generally includes a flexible membrane that contacts the back or unpolished surface of the work piece and accommodates variations in that surface. One or more pressure chambers may be provided behind the membrane so that different pressures can be applied to various locations on the back surface of the work piece to cause uniform polishing across the front surface of the work piece. The carrier head also generally includes a wear ring (sometimes referred to as a "retaining ring" or "edge ring" but hereinafter referred to without limitation as a "wear ring") that surrounds the membrane and the work piece and that pre-stresses or pre-compresses the polishing pad to protect the leading edge of the work piece. The height of the wear ring generally, but not always, can be adjusted. The polishing pad may move in a linear motion, a rotational motion, or an orbital motion, depending on the type of CMP apparatus. Additionally, the carrier head, and hence the work piece, may also be in rotational motion. The relative motion between the work piece and the polishing pad is designed to attempt to provide equal polishing to all areas of the polished surface.

Despite all the efforts to achieve uniform polishing across a work piece surface, however, a uniform removal rate has not been obtained. Instead, a "slow band," exists around the edge of the work piece. For example, examination of a semiconductor wafer that has undergone a CMP process exhibits a band around its periphery, spaced inwardly from the edge of the wafer, that has experienced a slower material removal rate than has the remainder of the wafer. The slow band exists regardless of whether the wafer is 200 mm or 300 mm in diameter and regardless of membrane pressures, slurry composition, polishing speed, relative motion, or other CMP conditions. The existence of a slow band reduces the yield of the semiconductor wafer because the slow band causes a non-planar surface, and subsequent processing steps require a substantially planar surface. Lower yield, of course, is undesirable. Accordingly, a need existed for a carrier head for use in a CMP or other polishing process that would overcome the problems of the prior art carrier heads and would produce a uniform planar work piece surface without evidence of a slow band or other surface anomaly.

BRIEF DESCRIPTION OF THE DRAWINGS

The present invention will be described herein in conjunction with the appended drawing figures in which.

DETAILED DESCRIPTION OF PREFERRED EMBODIMENTS

Figure 1:
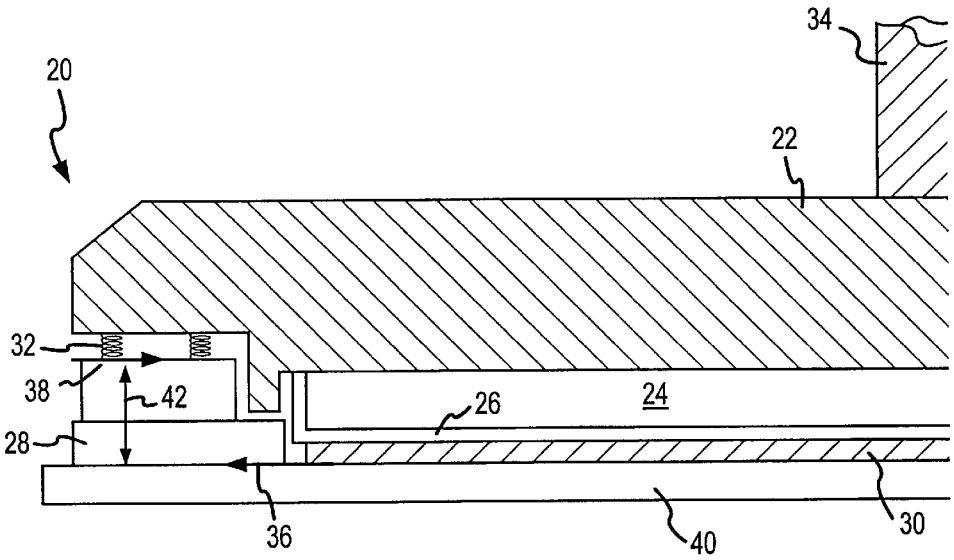
(PRIOR ART) FIG.1
FIG. 1 illustrates, in cross section, basic components of a prior art carrier head for a CMP apparatus.

FIG. 1 illustrates schematically, in cross section, basic elements of a carrier head 20 for a CMP apparatus in accordance with a prior art structure. The carrier head controllably presses a work piece, such as a semiconductor wafer 30, into contact with a polishing pad 40 to planarize the lower surface of the wafer. Carrier head 20 includes a rigid casing 22 having a cavity 24 on a lower surface. A flexible membrane 26 is stretched across the cavity and presses against the upper surface of wafer 30. A wear ring 28 is attached to the rigid casing with a resilient attachment, here illustrated by springs 32. The wear ring surrounds cavity 24 and serves to precondition the polishing pad and to contain the lateral movement of wafer 30, thus maintaining the wafer in position on the underside of carrier head 20. The wear ring is positioned with its lower surface in substantially the same plane as the lower surface of the wafer. Alternatively, the lower surface of the wear ring may be in a plane that is parallel to the plane of the lower surface of wafer 30 but that is slightly displaced, either positively or negatively, in the vertical direction (say, by about 0.25 mm or less) from the wafer plane. Either of these conditions will be defined and referred to herein as "coplanar." The resilient attachment allows adjustment of the vertical height of the wear ring, for example, to accommodate wafers of different thickness, and also allows correction for any mechanical tolerances in the rigid casing, the wear ring itself, or any other mechanical parts in the system. Without the resilient attachment, precise machining of components might be necessary to achieve initial coplanarity of the wear ring and wafer. Rigid casing 22 is attached to a shaft 34 by means of which the correct downward pressure can be applied to the carrier head and hence to wafer 30. Shaft 34 may also be used to impart a rotational motion to the carrier head to improve uniformity of the polishing action.

In a conventional CMP process using a carrier head such as carrier head 20, wafer 30 is pressed into contact with polishing pad 40 in the presence of a polishing slurry. The pressure on the wafer is exerted by the carrier head through the pressure from shaft 34. To obtain a uniform pressure across the wafer and thus hopefully a uniform material removal rate, pressure is exerted against flexible membrane 26 by pressurized gasses or fluids that are conveyed to cavity 24. The flexible membrane conforms to the shape of the upper surface of wafer 30 and presses the wafer against the polishing pad. Although only a single cavity 24 is illustrated, in some applications multiple cavities and multiple pressures are used to press the wafer against the polishing pad in an attempt to even out nonuniformities in the removal rate.

The polishing pad may be in rotational, orbital, or linear motion relative to wafer 30, depending on the particular type of CMP apparatus being utilized. Carrier head 20 may also be rotating on shaft 34. Regardless of the type of polishing pad motion, that motion can be viewed, at any instant of time, as a linear motion relative to the surface of the wafer and relative to the lower surface of wear ring 28. Such motion is illustrated by arrow 36 in FIG. 1. Arrow 36 indicates the direction polishing pad 40 is moving relative to the wafer and the wear ring. As the polishing pad moves relative to the wear ring, the pad exerts a frictional force on the wear ring. Arrow 36 also indicates the direction of the frictional force exerted by the polishing pad on the wear ring. Arrow 36 can thus be viewed as a frictional force vector representing the frictional force acting on the wear ring. The frictional force induces a reaction force, and in a similar manner arrow 38 indicates the direction of the reaction force countering the friction force and acting on the wear ring at its point of resilient attachment to the rigid carrier plate. Arrow 38 can thus be viewed as the wear ring reaction force vector.

Figure 2:
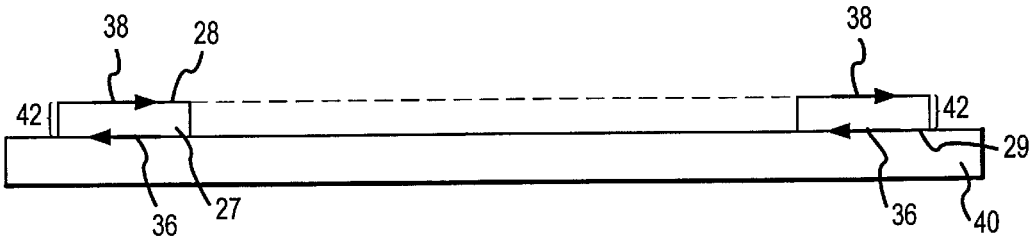
(PRIOR ART) FIG.2
FIG. 2 illustrates, in cross section, the wear ring of the prior art carrier head and the forces acting thereon.

Recall that the wear ring is a circular ring positioned about the circumference of the carrier head. While the above-described forces are acting on one edge or the wear ring (the left hand edge as illustrated in FIG. 1) the same forces are acting on other parts of the wear ring with different effect. FIG. 2 illustrates, in cross section, wear ring 28 in contact with a moving polishing pad 40. Frictional force vector 36 and reaction force vector 38 are indicated at both the left and right hand extremes of the wear ring.

The friction force vector and the wear ring reaction force vector are not collinear, but rather are separated by a moment arm identified by the numeral 42. The two forces acting on the wear ring through a non zero moment arm form an instantaneous overturning moment in the wear ring system. The overturning moment has a different effect at various locations around the wear ring. For example, at the left edge of FIG. 2 the overturning moment causes the inner edge 27 of the wear ring to dip. At the right edge of the figure the overturning moment causes the outer edge 29 of the wear ring to dip. At locations on the wear ring that are intermediate between these two extremes, the dip experienced by the wear ring varies from inner edge dip to no dip to outer edge dip. Moreover, the overturning moment acting on a particular location on the wear ring is constantly changing as the carrier head rotates and the polishing pad rotates, orbits or otherwise changes direction. The lack of coplanarity causes a non-uniform distribution of pressure of the wear ring against the polishing pad. Most, if not all carrier heads initially have the wear ring coplanar with the surface of the work piece to be polished and ideally establish a uniform pressure of the wear ring against the polishing pad. Prior art carrier heads, however, have not been constructed to maintain the wear ring coplanar with the work piece surface. The overturning moment causes the wear ring to pivot and to become non-coplanar with the work piece surface. This lack of coplanarity is non-uniform about the circumference of the wear ring and is constantly changing.

The inventors of the present invention have discovered that this overturning moment acting on the wear ring is the cause of the slow band. The inventors have discovered that reducing the overturning moment results in a reduction of the slow band and eliminating the overturning moment eliminates the slow band. In accordance with the invention, a carrier head is provided that overcomes the deficiencies of the prior art carrier heads.

The following non-limiting examples illustrate various results in connection with practice of the invention.

EXAMPLE 1

Figure 3:
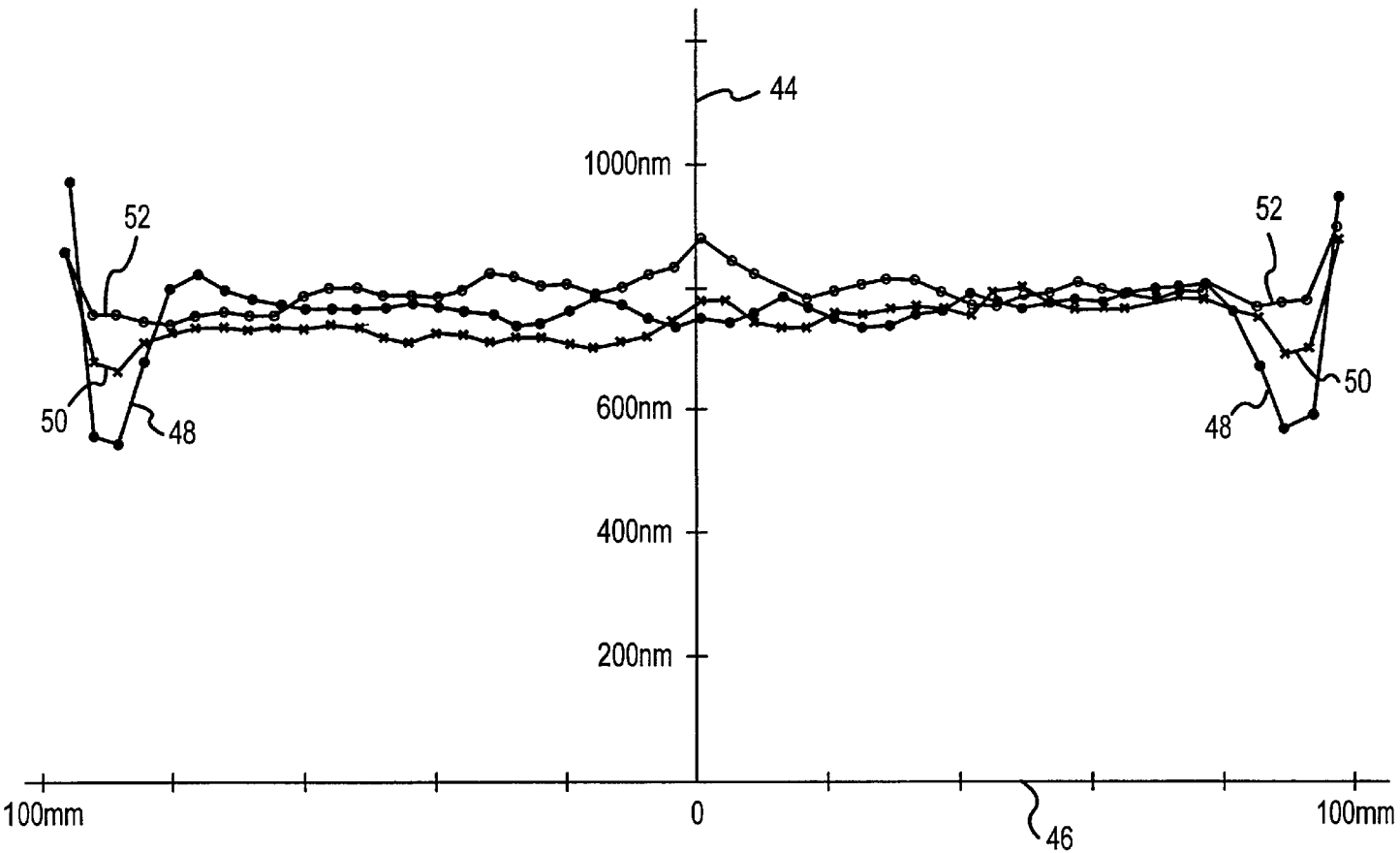
FIGS. 3 and 4 illustrate, in graphical form, polishing results achieved using different work piece carrier heads.

Semiconductor wafers having a diameter of 200 mm were planarized by a CMP process using three different wafer carrier heads. The three carrier heads were designed to have ,moment arms of approximately 20 mm, 7.6 mm, and 0 mm, respectively. The carrier heads were similar in all other respects. The same CMP process was used with each carrier head. FIG. 3 illustrates, in graphical form, the uniformity of removal rate achieved by polishing the semiconductor wafers using the three different carrier heads. Vertical axis 44 indicates the amount of material removed. Horizontal axis 46 indicates the edge to edge wafer profile. The amount of material removed from the surface of the wafers was nominally 1.0 $\mu$m. Curve 48 indicates the polishing results achieved with a carrier head having a moment arm of about 20 mm. A slow band is seen to exist about the periphery of the wafer. The slow band has a width of about 24–30 mm with the point of slowest removal rate located about 12 mm from the edge of the wafer. It is this slow band that previously has been observed on all types of CMP equipment. The cause of this phenomena has usually been explained as a non-uniform pressure distribution on the wafer. Attempts to solve the slow band problem have previously focused on the design of the flexible membrane that presses against the back of the wafer and on the design of the carrier head cavity in an attempt to tailor the pressure distribution. These attempts have been largely unsuccessful as indicated by curve 48. In contrast, curve 50 indicates the polishing results achieved with a carrier head for which the moment arm has been reduced to about 7.6 mm. Although the slow band is still evident, the severity of the slow band is seen to be reduced. Curve 52 indicates the polishing results achieved with a carrier head for which the moment arm has been reduced to substantially zero. The results indicate that the slow band has essentially been eliminated. A uniform removal rate is achieved across the entire surface of the wafer. Similar results were achieved using semiconductor wafers having a diameter of about 300 mm.

EXAMPLE 2

Figure 4:
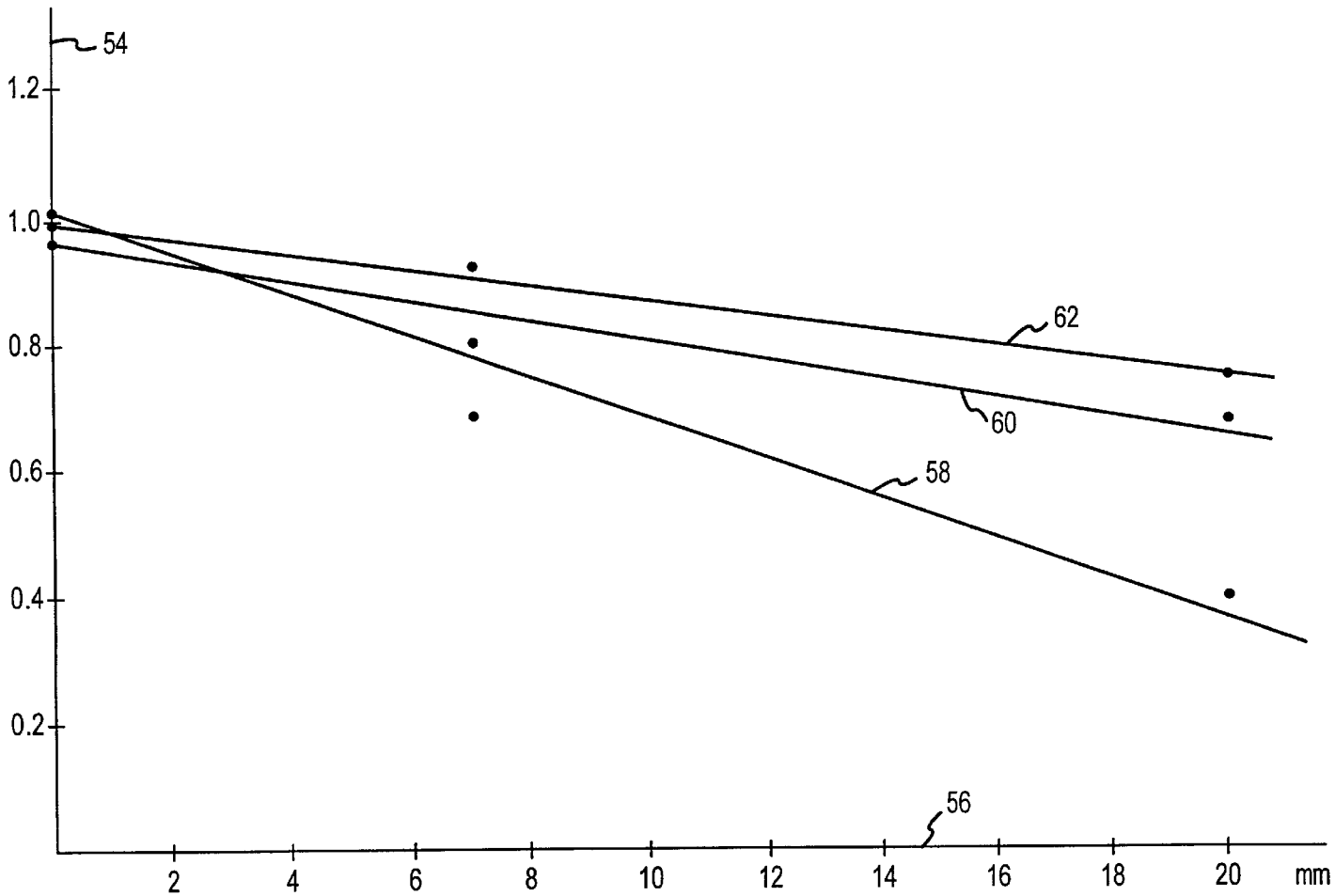

Additional semiconductor wafers were planarized by a CMP process by varying the polishing pressure, that is, the pressure exerted by the polishing pad against the surface of the wafer. FIG. 4 illustrates graphically the polish performance at three polishing pressures for the three wear ring designs used in Example 1. Vertical axis 54 is the removal rate of the slowest point of the slow band normalized to the mean of the overall diameter-scan removal rate. On this scale a value of 1 means that the removal rate in the slow band is the same as the average removal rate across the wafer. That is, a value of one means that there is no measurable slow band. Horizontal axis 56 is the moment arm height. Curve 58 illustrates the results for a polishing pressure of 1 pound per square inch (psi), curve 60 illustrates the results for a polishing pressure of 2.5 psi, and curve 62 illustrates the results for a polishing pressure of 6 psi. For each of the polishing pressure investigated, the slow band is reduced as the moment arm is reduced, and the slow band substantially disappears for a zero moment arm.

Figure 5:
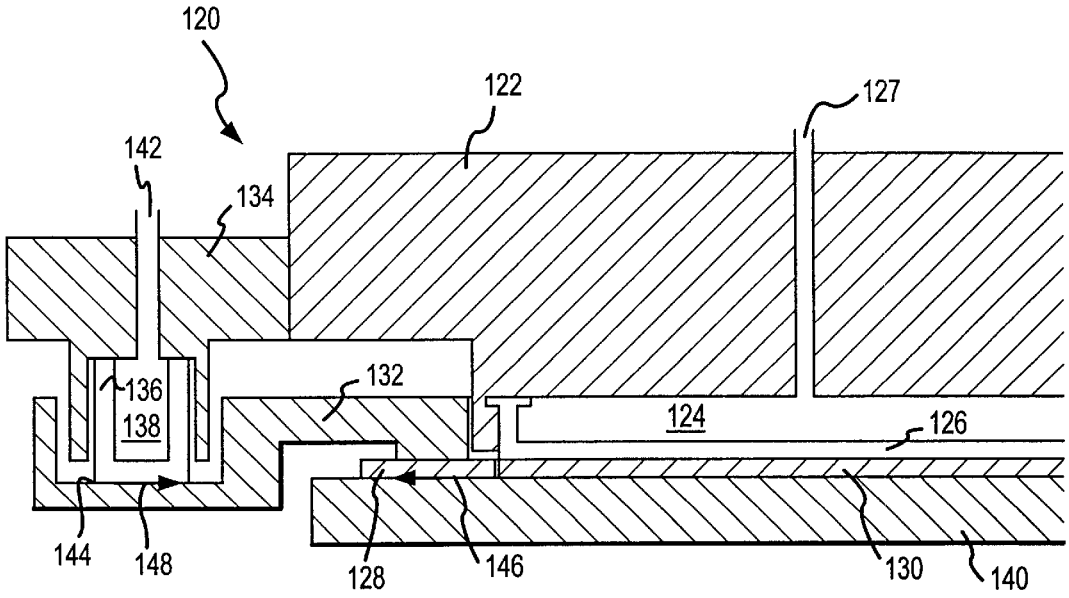
FIGS. 5–10, 12 and 13 illustrate, in cross section, portions of carrier heads in accordance with various embodiments of the invention.

FIG. 5 schematically illustrates, in cross section, an edge portion of a work piece carrier head 120 in accordance with one embodiment of the invention. Carrier head 120 can be used in any polishing apparatus, but is especially adapted for use in a CMP apparatus. The carrier head, which is generally circular in shape, includes a rigid carrier plate 122 that can be coupled to a shaft (not illustrated) that can impart vertical as well as rotary motion to the carrier plate. The carrier plate can be formed of stainless steel or other metal or rigid material, preferably a material that is substantially inert with respect to the slurry composition. A cylindrical cavity 124 is formed in the underside of the rigid carrier plate and a flexible membrane 126 is stretched across the open side of the cavity. The cavity and the flexible membrane thus form an enclosed space within which the pressure can be controlled. A port 127, extending through the rigid carrier plate to cavity 124, allows the pressure within the enclosed space to be adjusted as needed. The diameter of the cylindrical cavity is configured to accommodate the size of the work piece to be polished. During a polishing operation, the flexible membrane contacts the upper surface of a work piece 130 and presses the lower surface of the work piece against a polishing pad 140. Although only one cavity is illustrated in the figure, the carrier head can be configured with more than one cavity with an independent pressure port associated with each cavity. A plurality of independent cavities allows different pressures to be applied by the flexible membrane to various locations on the work piece surface.

Work piece carrier head 120 also includes a wear ring 128 that is resiliently coupled to the rigid carrier plate and that is positioned to surround a work piece during a polishing operation. The height of the lower surface of the wear ring is initially adjusted, by the resilient coupling as will be explained more fully below, to be substantially coplanar with the lower surface of the work piece. In accordance with one embodiment of the invention, wear ring 128 can be coupled to a wear ring pressure plate 132. Wear ring pressure plate 132 is constrained to move vertically relative to an outwardly extending portion 134 of rigid carrier plate 122. Stops (not illustrated) or the like can be used to limit the vertical motion to the small range necessary to achieve the necessary coplanarity. A wear ring diaphragm 136 is positioned in cavity 138 in the outwardly extending portion. Pressure in the cavity and hence on the wear ring diaphragm is controlled by gases or other fluids conveyed to the cavity by a port 142 extending through the outwardly extending portion of the rigid carrier plate. The vertical height of wear ring 128 is controlled by controlling the pressure on diaphragm 136 which is configured to press against surface 144 of the wear ring pressure plate. The height of the wear ring is controlled by the equilibrium established by the diaphragm pressure and the resilience or resistance of the polishing pad. Wear ring pressure plate 132 is configured so that surface 144 is coplanar with the bottom surface of wear ring 128. The resilient connection point between the rigid carrier plate and the wear ring is thus effectively positioned at the height of the lower surface of the wear ring. The illustrated method and means for controlling the vertical positioning of the wear ring provides a positioning adjustment that is independent of the work piece positioning which is controlled by flexible membrane 126.

As the polishing pad moves relative to the work piece and the wear ring, for example from right to left in the figure, the polishing pad exerts a frictional force on the wear ring. Arrow 146 represents the frictional force vector associated with that force. Arrow 148 represents the wear ring reaction force vector. Because of the manner in which the wear ring is resiliently coupled to the rigid carrier plate with the resilient connection point positioned at the height of the lower surface of the wear ring, the two forces are substantially collinear. Stated in other words, the gimbal point for the wear ring or the point about which the wear ring can rotate or pivot is located substantially in the same plane as is the friction force vector. There is thus no overturning moment applied to the wear ring and the wear ring remains coplanar with the polished surface of the work piece during the polishing operation. Because there is no overturning moment applied to the wear ring, the pressure applied to the polishing pad by the wear ring is uniform about the circumference of the wear ring. A slow band is thus avoided when a polishing progress such as a CMP process is carried out using a carrier head such as carrier head 120. Although the illustrated wear ring coupling uses a flexible diaphragm to control the height of the wear ring, many other mechanisms can also be used. For example, springs or the like can be substituted for the diaphragm. Regardless of the height adjusting mechanism, in accordance with this embodiment of the invention, the gimbal point is located to minimize or eliminate the overturning moment applied to the wear ring.

Figure 6:
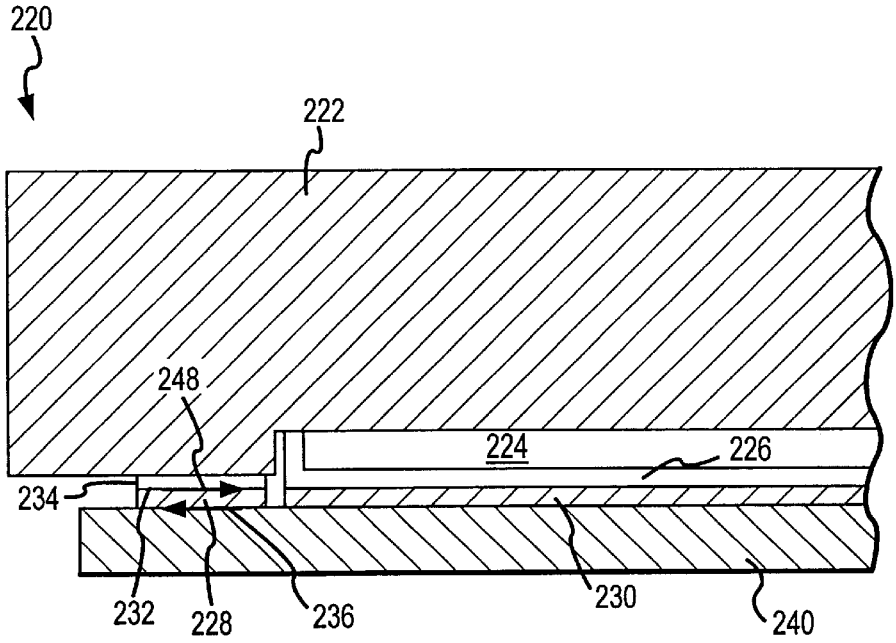

FIG. 6 illustrates schematically, in cross section, a portion of a carrier head 220 in accordance with a further embodiment of the invention. Many components of carrier head 220 have the same or similar function as the components in carrier head 120 described above. Those components will not be described again in detail. For example, carrier head 220 includes a rigid carrier plate 222, a cavity 224, and a flexible work piece membrane 226. Wear ring 228 is resiliently attached to the rigid carrier plate at an attachment point 232 by a resilient adhesive layer 234. Layer 234 can be, for example, a thin layer of flexible adhesive material. Alternatively, layer 234 can be a layer of resilient material bonded to both the rigid carrier plate and to the wear ring. Preferably layer 234 is a layer of foam tape having adhesive on both surfaces such as the foam tape available from 3M and designated by the number 4920. Such foam tape has a thickness of about 0.38 mm (0.015 inch). To polish a semiconductor wafer 230 having a thickness of about 0.71 mm (0.028 inch), a wear ring having a thickness of about 0.51 mm (0.02 inch) has been found to work suitably with the above described foam tape. If the flexible membrane is configured so that the lower surface of membrane 226 is at the same height as attachment point 232, the lower surface of wear ring 228 initially will be lower than the lower surface of the semiconductor wafer by about 0.18 mm. The lower surface of the wear ring is thus in a parallel plane with and substantially coplanar with the lower surface of the semiconductor wafer. A small overturning moment is exerted on wear ring 228 by a frictional force 236 exerted by the lateral motion of polishing pad and by a reaction force 248 exerted on the wear ring at the attachment point 232. The moment arm for such overturning moment is equal to the 0.51 mm thickness of the wear ring, substantially less than the moment arm found in prior art structures. Accordingly, referring back to the data in FIG. 3, the slow band resulting from the use of carrier head 220 is significantly reduced compared to prior art structures. Again, the illustrated method and means for resiliently coupling the wear ring to the rigid carrier plate provides a positioning adjustment that is independent of the work piece positioning which is controlled by flexible work piece membrane 226.

Figure 7:
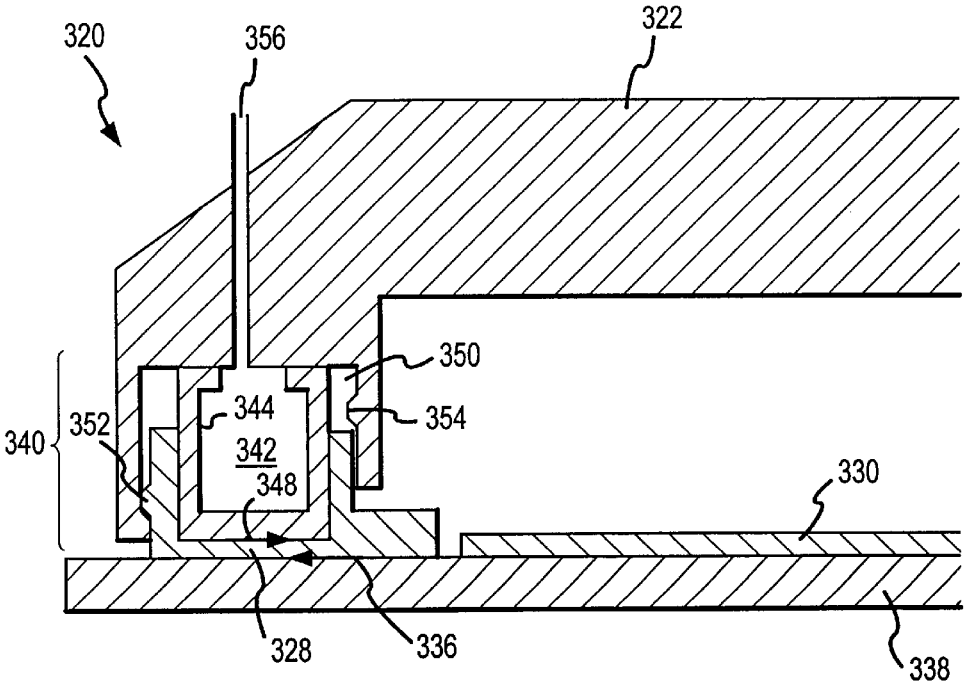

FIG. 7 illustrates, in cross section, a portion of a work piece carrier head 320 in accordance with a further embodiment of the invention. Again, the carrier head includes a rigid carrier plate 322 that is configured to apply an appropriate downward pressure on a work piece 330 that is to be polished, pressing that work piece against a polishing pad 338. Certain components of carrier head 320 have similar functions to the components in carrier heads described above. Those components will not be described or illustrated again. A wear ring assembly 340 is provided about the periphery of the rigid carrier plate, surrounding the work piece location. The wear ring assembly includes an interior chamber 342 and a thin wear ring 328 located at the lower extremity of the assembly. A flexible bladder 344 is positioned within chamber 342 and, when inflated, is capable of pressing against the upper surface of wear ring 328. The wear ring assembly 340 is confined to move in a vertical direction within a channel 350 in the rigid carrier plate. Stops 352 and 354 on the wear ring assembly and the rigid carrier plate, respectively, limit the extent of the vertical travel of the wear ring assembly. The flexible bladder is inflated through a port 356 that extends through rigid plate 322 and is coupled to a pump (not illustrated). At the initiation of a polishing operation the height of the wear ring can be adjusted to position the lower surface of the wear ring substantially coplanar with the lower surface of the work piece that is to be polished. The gimbal point for the wear ring assembly is located at the upper surface of the wear ring at its point of contact with flexible bladder 344. By making the wear ring thin, preferably less than about 0.75 mm, the gimbal point is located close to the plane of any frictional force vector applied to the wear ring by the motion of the polishing pad. The overturning moment applied to the wear ring by a frictional force 336 and a reaction force 348 is reduced in comparison to the overturning moment associated with prior art carrier head structures and the slow band encountered by polishing a work piece using such a carrier head is reduced.

Figure 8:
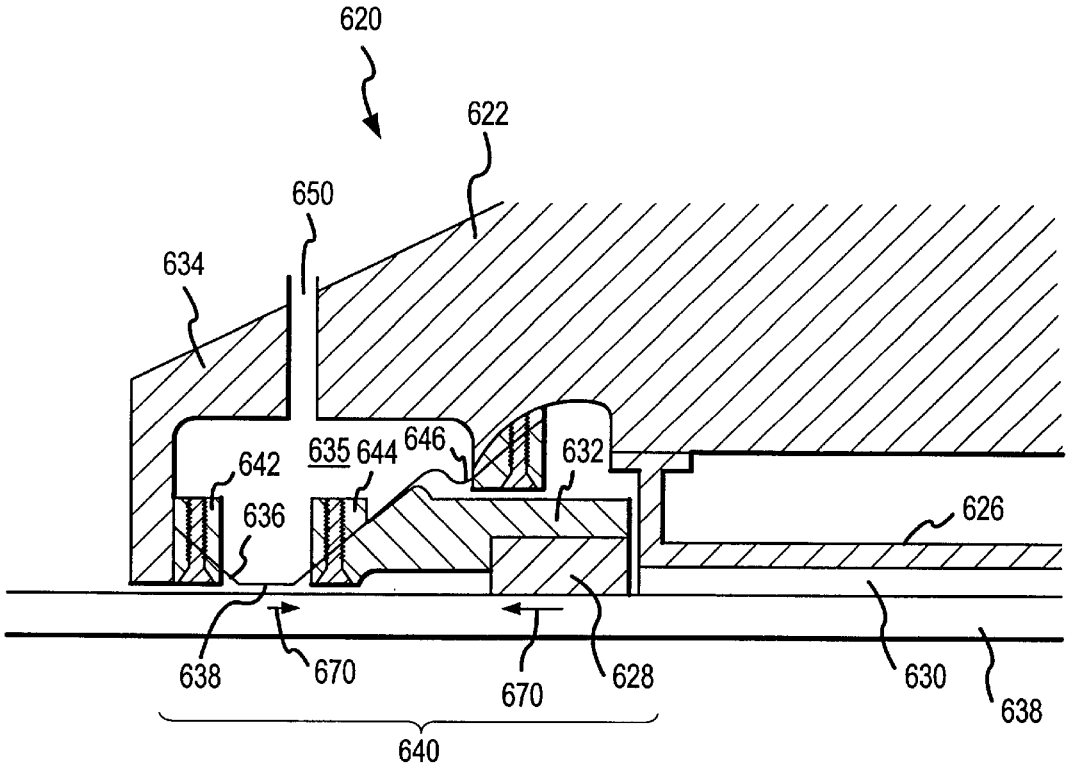

FIG. 8 schematically illustrates, in cross section, a portion of a work piece carrier head 620 in accordance with a further embodiment of the invention that provides a zero overturning moment on wear ring 628 without requiring any hardware below the plane of the work piece that is to be polished. Again, the carrier head includes a rigid carrier plate 622 that is configured to apply an appropriate downward pressure, through a flexible work piece membrane 626, against a work piece 630, pressing that work piece against a polishing pad 638. A wear ring assembly 640 is provided about the periphery of the rigid carrier plate, surrounding the work piece location. The wear ring assembly provides a resilient coupling between wear ring 628 and the rigid carrier plate. The wear ring assembly includes a wear ring 628 that is rigidly attached to a wear ring pressure plate 632. An outwardly extending portion 634 of the rigid carrier plate 622 is configured to provide a wear ring pressure cavity 635. Wear ring pressure plate 632 is confined to move vertically with respect to the outwardly extending portion. A wear ring diaphragm 636 is positioned across the lower extremity of cavity 635. Wear ring diaphragm 636 includes a substantially planar portion 638 that is positioned coplanar with the lower surface of wear ring 628. The wear ring diaphragm is clamped at one side between the outwardly extending portion of rigid carrier plate 622 and a clamping block 642. The wear ring diaphragm is clamped at the opposite side of the substantially planar portion between the wear ring pressure plate and a second clamping block 644. The wear ring diaphragm also includes a pressure slack portion 646 that is clamped to the rigid carrier plate to provide a pressure seal within cavity 635. The pressure slack portion can be formed of a material having a low stiffness modulus or, alternatively, as illustrated, can be formed having a slack, bowed shape. The pressure slack portion of the wear ring diaphragm is configured to complete the seal of cavity 635 without making a moment contribution to the forces acting on the wear ring. A port 650 through the rigid carrier plate allows the pressure within cavity 635 to be controlled.

The height of wear ring 628 is controlled by controlling the pressure within cavity 635. The height of the wear ring is determined by the equilibrium between the pressure in the cavity and the resilience of the polishing pad against which the wear ring presses. The height of the lower surface of the wear ring, determined independently of the height of the work piece to be polished (which is determined by the pressure on flexible work piece membrane 626), is initially set to be substantially coplanar with the lower surface of the wear ring. As the polishing pad moves relative to the wear ring, the polishing pad exerts a frictional force on the wear ring. This frictional force is represented by the frictional force vector 670. A wear ring response force represented by the response force vector 672 is coplanar with the substantially planar portion 638 of wear ring diaphragm 636 because this is the point of resilient coupling between the wear ring and the rigid carrier plate and forms the gimbal point about which the wear ring can pivot. The frictional force vector and the response force vector are thus coplanar and no overturning moment acts upon the wear ring. The wear ring remains coplanar with the lower surface of work piece 630 throughout the polishing operation, the pressure between the wear ring and the polishing pad remains uniform about the entire wear ring, and the presence of a slow band is avoided.

Figure 9:
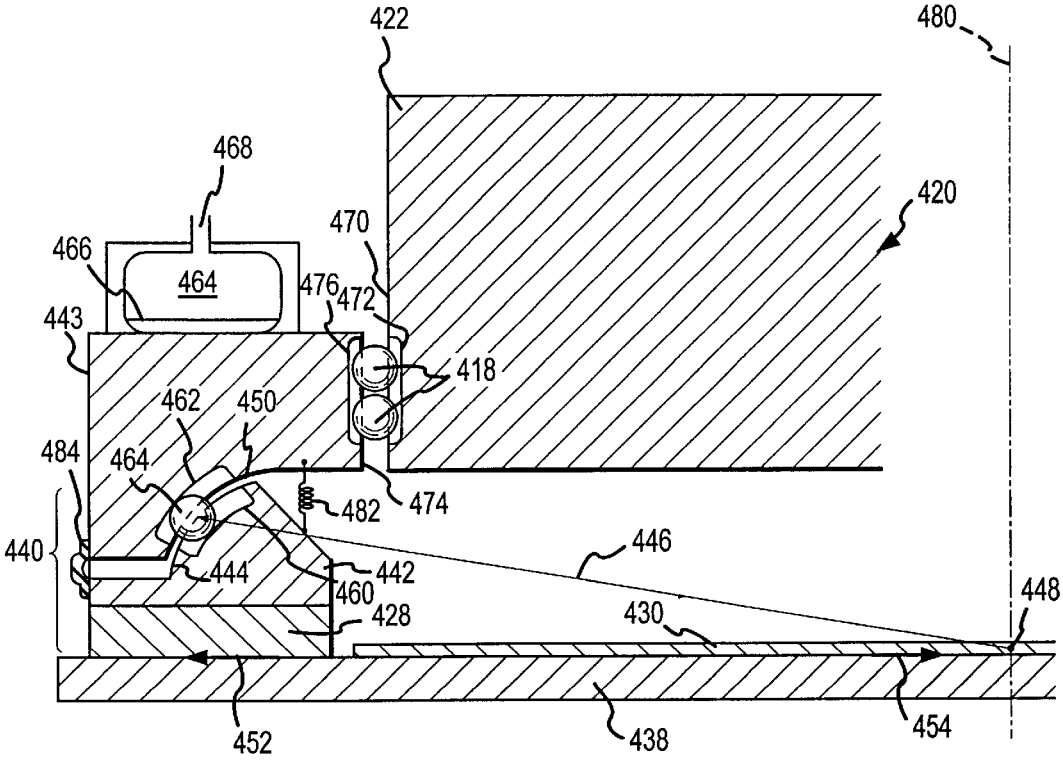

FIG. 9 illustrates, in cross section, a portion of a work piece carrier head 420 in accordance with yet a further embodiment of the invention. Again, the carrier head includes a rigid carrier plate 422 that is configured to apply an appropriate downward pressure on a work piece 430 that is to be polished, pressing that work piece against a polishing pad 438. A flexible membrane (not illustrated), for example, can be employed to supply the appropriate pressure against the upper surface of the work piece. A wear ring assembly 440 is provided about the periphery of the rigid carrier plate, surrounding the work piece location. Wear ring assembly 440 provides a resilient coupling between wear ring 428 and the rigid carrier plate. In accordance with this embodiment of the invention, the wear ring assembly achieves a reduced overturning moment or zero overturning moment applied to the wear ring by frictional forces caused by the relative motion between a polishing pad 438 and the wear ring without moving the wear ring suspension system to or near the plane of the work piece. Instead, the wear ring coupling utilizes a virtual pivot for the wear ring. The suspension system for the wear ring pivots about a point at the center of the work piece. The wear ring assembly includes a wear ring backing plate 442 to which wear ring 428 is attached. The wear ring backing plate has a convex spherical upper surface 444 having a radius 446 centered at the center 448 of the work piece. Wear ring drive plate 443 is configured with a mating concave spherical surface 450 having the same radius of curvature as surface 444. Downward pressure on the wear ring drive plate presses wear ring 428 into contact with the polishing pad. A frictional force on wear ring 428, represented by the force vector 452, caused by the motion of the polishing pad relative to the wear ring is reacted by a reaction force directed along radius 446 and having a horizontal component represented by the force vector 454. Both force vector 452 and force vector 454 project through the center of the work piece. The sum of the moments about the center of the work piece is equal to zero and there is no resulting overturning moment applied to the wear ring. Accordingly, no slow band results when a work piece is polished using a work piece carrier head such as work piece carrier head 420.

FIG. 9 also illustrates further details of work piece carrier head 420 in accordance with one embodiment of the invention. Wear ring backing plate can be provided with a plurality of ball races 460 spaced about the circumference of the convex upper surface of the backing plate. Wear ring drive plate 443 can be provided with a plurality of matching ball races 462 spaced about the concave lower surface of the drive plate. The ball races are vertically oriented grooves in the respective surfaces configured to confine a plurality of ball bearings 464. The ball bearings allow the easy rotation of wear ring backing plate with respect to the wear ring drive plate in the direction parallel to the races. At the same time the presence of the ball bearings in the races allow a rotational motion (to be explained below) of rigid carrier plate 422 and wear ring drive plate 443 to be transmitted to wear ring backing plate 442 and to wear ring 428. The downward pressure on wear ring 428 can be controlled by pressure applied to wear ring drive plate 443. The pressure on the wear ring drive plate can be applied, for example, by controlling the pressure in a chamber 464 coupled to the drive plate. A flexible diaphragm 466 at the lower extremity of that chamber can be configured to press against the upper surface of the wear ring drive plate. Pressure in the chamber can be controlled by forcing a compressed gas into the chamber through a port 468. Alternatively, mechanical springs or the like can be used to apply the appropriate pressure to wear ring drive plate 443. Wear ring drive plate 443 can be coupled to rigid carrier plate 422 in a manner similar to the coupling between the wear ring drive plate and wear ring backing plate 442. Rigid carrier plate 422 can be configured to have a cylindrical surface 470 provided with a plurality of ball races 472 spaced about its cylindrical surface. Wear ring drive plate 443 can be configured to have a cylindrical inner surface 474 with a plurality of ball races 476 spaced about its cylindrical surface and aligned with ball races 472. Ball bearings 478 confined in the ball races allow the wear ring drive plate to move vertically with respect to the rigid carrier plate, but allow rotational motion of the rigid carrier plate about a central axis 480 to be transferred to the wear ring drive plate. A spring 482 couples the wear ring backing plate to the wear ring drive plate. The spring is configured so as not to contribute to the moment applied to the wear ring, but allows the wear ring to be raised when the entire carrier head is raised. A flexible seal 484 extending from the wear ring backing plate to the, wear ring drive plate about the entire circumference of the carrier head prevents polishing slurry or other contaminants from contacting ball bearings 464.

Figure 10:
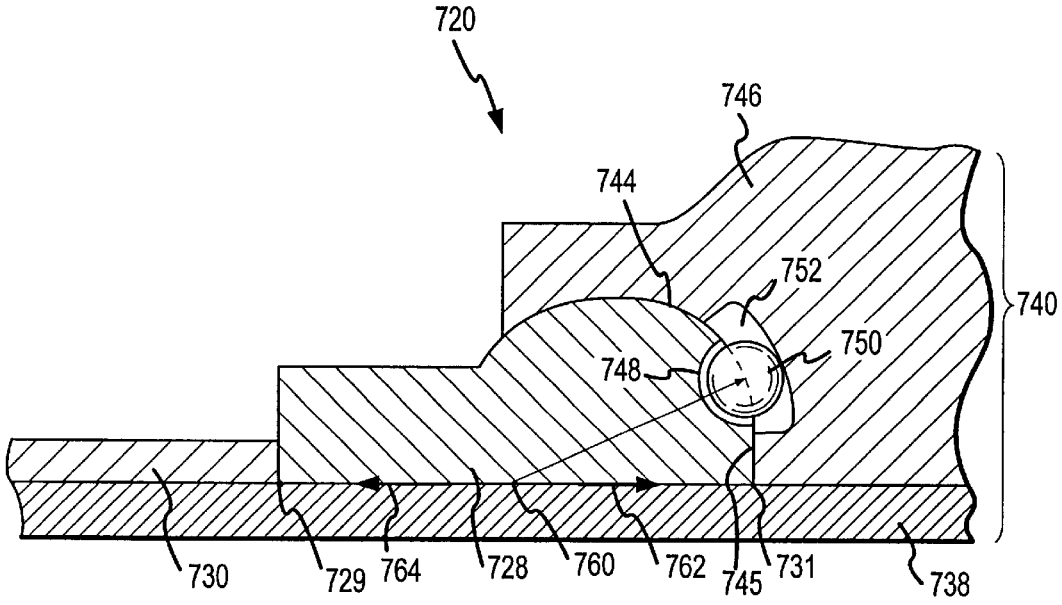

FIG. 10 schematically illustrates, in cross section, a portion of a work piece carrier head 720 utilizing a virtual pivot for a wear ring 728 in accordance with a further embodiment of the invention. Although not illustrated, the carrier head may include a rigid carrier plate, flexible membrane or other mechanism for pressing a work piece 730 against a polishing pad 738, and the like, as previously described in connection with other embodiments of the invention. A wear ring 728 and wear ring assembly 740 circumferentially surround the work piece. The wear ring presses against the polishing pad and aids in confining the work piece as the carrier head moves relative to the polishing pad. In accordance with one embodiment, wear ring 728 can be a single piece construction, as illustrated. Alternatively, the wear ring can be a wear ring attached to a wear ring backing plate as illustrated in other embodiments. A resilient coupling between the wear ring and the rigid carrier plate is provided as follows. A portion of the upper surface 744 of the wear ring includes a convex circular shape that mates with a concave circular surface 745 of a wear ring drive plate 746. The vertical positioning of the wear ring drive plate can be controlled, for example, in a manner similar to that described with respect to wear ring drive plate 443 illustrated above in FIG. 9. Upper surface 744 is configured to provide a plurality of ball races 748 spaced about the circumference of the wear ring for a plurality of ball bearings 750. Concave circular surface 745 is also configured to provide a plurality of ball races 752 for the ball bearings At least one of the sets of ball races, here illustrated to be ball races 752, is configured to have an elongate, vertical shape to allow the rotation, as necessary, of the wear ring with respect to the wear ring drive plate. As explained above, the ball bearings allow rotational motion of the wear ring drive plate to be coupled to the wear ring. In accordance with this embodiment of the invention the curvature of surface 744 is centered about a point 760 located at or near the lower surface of the wear ring in a plane substantially coplanar with the lower surface of work piece 730. Point 760 thus constitutes a pivot point for the rotation of wear ring 728. Pivot point 760 is preferably located equally distant from the inner edge 729 and the outer edge 731 of the wear ring. Friction force vector 762 represents the frictional force exerted on the wear ring by the frictional contact of the moving polishing pad 738 against the lower surface of the wear ring. Reaction force vector 764 represents the reaction force from the resilient coupling acting on the wear ring. Because the coupling provides for rotation of the wear ring about point 760 at or near the lower surface of the wear ring, the frictional force vector and the reaction force vector are substantially collinear and no overturning moment is applied to the wear ring. If point 760 is spaced apart from the lower surface of the wear ring, that spacing constitutes the moment arm for the two forces. The spacing can be made small, however, so that the overturning moment applied to the wear ring is small compared to prior art carrier heads. Accordingly, polishing a work piece using a carrier head such as carrier head 720 results in a reduced or even zero slow band compared to polishing with a prior art carrier head.

Figure 11:
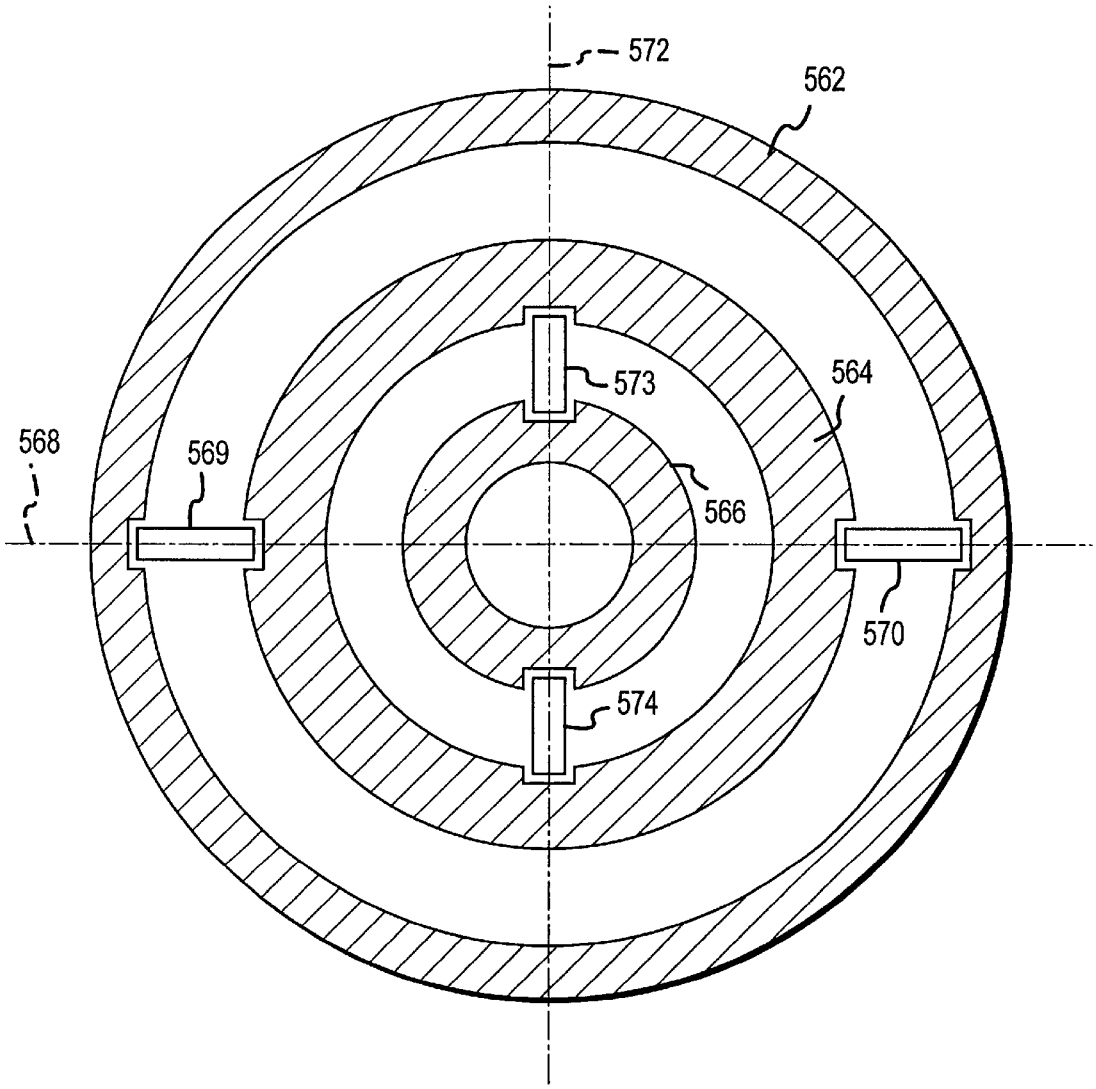
FIG. 11 illustrates, in top view, a gimbal for use with the carrier head of FIG. 12.
Figure 12:
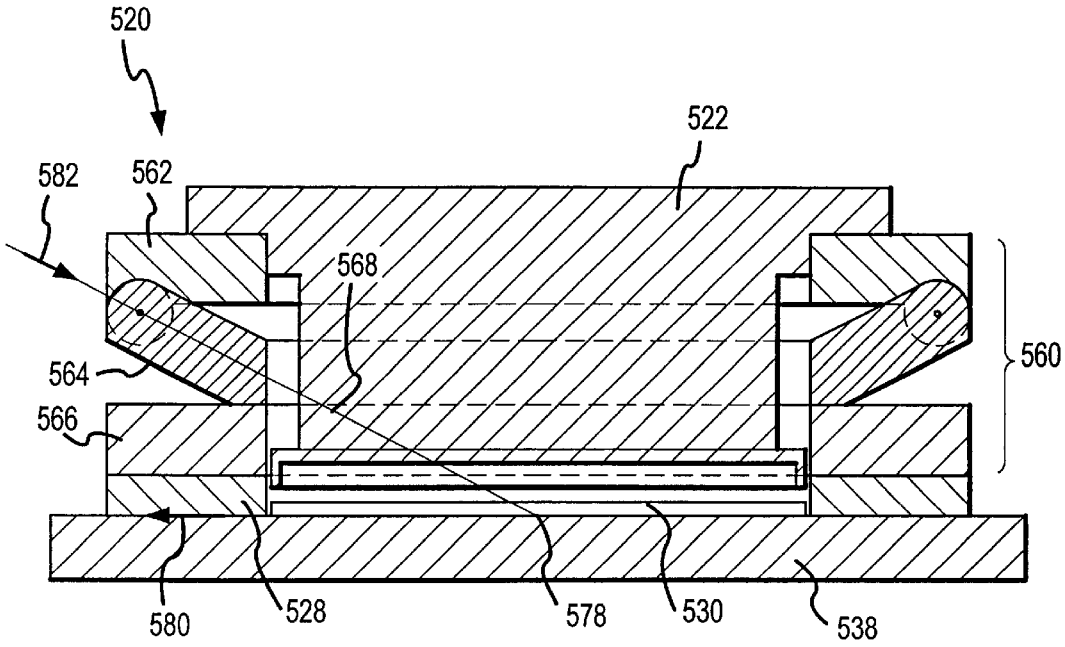

A work piece carrier head having a zero moment wear ring that utilizes a virtual pivot can be achieved in other ways than those illustrated in FIGS. 9 and 10. For example, a wear ring 528 can be resiliently coupled to a rigid carrier plate 522 by a central focused gimbal arrangement 560 illustrated in FIGS. 11 and 12. FIG. 11 schematically illustrates the gimbal arrangement in top view. FIG. 12 illustrates schematically, in cross section, a work piece carrier head 520, including gimbal arrangement 560, in accordance with a further embodiment of the invention. Carrier head 520 includes a rigid carrier plate 522 that is configured to apply an appropriate downward pressure on a work piece 530 that is to be polished, pressing that work piece against a polishing pad 538. A wear ring 528 is provided about the periphery of the rigid carrier plate, surrounding the work piece location. Gimbal arrangement 560 provides a resilient coupling between wear ring 528 and the rigid carrier plate.

As schematically illustrated, gimbal arrangement 560 includes three concentric components: top ring 562, middle ring 564, and bottom ring 566. The top ring and the middle ring are pivotally joined along x-axis 568 by pivot pins 569 and 570. Each of the pivot pins can be coupled to the respective rings by bearings to allow easy rotation along the x-axis of the middle ring with respect to the top ring. Similarly, the middle ring and the bottom ring are pivotally joined along the y-axis 572 by pivot pins 573 and 574. Each of pivot pins 573 and 574 can be coupled to the respective rings by bearings to allow easy rotation along the y-axis of the bottom ring with respect to the middle ring. As illustrated in FIG. 12, middle ring 564 and the coupling between the middle ring and each of the top ring and the bottom ring are configured so that middle ring 564 and the x and y axes lie along a radius of a cone emanating from a point at the center of work piece 530. (The coupling between the middle ring and the bottom ring is into the plane of the figure and is not seen in this cross section.) This creates a virtual pivot point at the center 578 of the work piece. Top ring 562 is rigidly coupled to rigid carrier plate 522. Bottom ring 566 is rigidly coupled to wear ring 528. As wear ring 528 is pressed against polishing pad 538 and the polishing pad is in motion relative to the wear ring, a frictional force represented by the friction force vector 580 is applied to the wear ring. Because of the work piece centric virtual pivot point 578, the force reacting to the friction force is directed toward the center of the work piece. The reacting force is represented by the reaction force vector 582. Both the friction force vector and the reaction force vector, if extended, pass through centric pivot point 578. Accordingly, the sum of the moments about the center of the work piece is equal to zero and there is no resulting overturning moment applied to the wear ring and the slow band is avoided when a work piece is polished.

Figure 13:
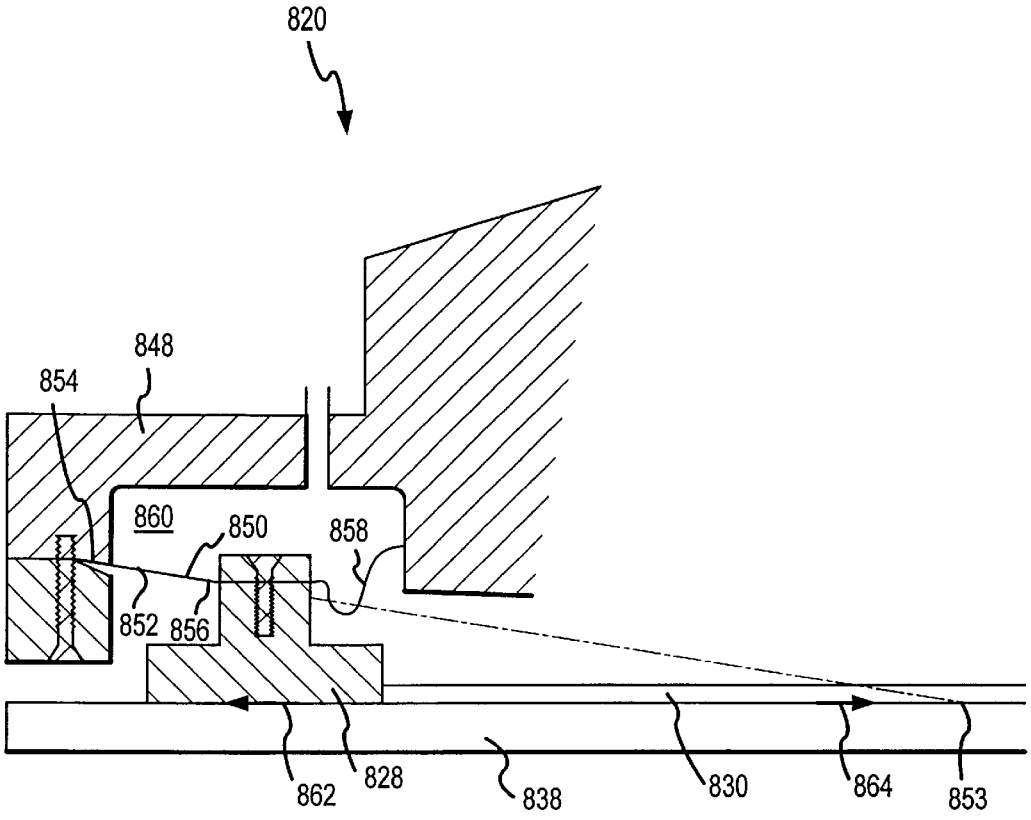

FIG. 13 illustrates schematically, in cross section, still another work piece carrier head 820 in accordance with another embodiment of the invention. Although not illustrated, the carrier head may include a rigid carrier plate, flexible membrane or other mechanism for pressing a work piece 830 against a polishing pad 838, and the like, as previously described and illustrated in connection with other embodiments of the invention. A wear ring 828 circumferentially surrounds the work piece. The wear ring is resiliently coupled to a portion 848 of a rigid carrier plate or an extension thereof by a diaphragm 850 in a manner to be described below. Diaphragm 850 includes a conical portion 852 which, if projected, would pass through a point 853 at the center of the lower surface of work piece 830. The outer extremity 854 of the conical portion of the diaphragm is clamped to portion 848. The inner extremity 856 of the conical portion of the diaphragm is clamped to the wear ring. Diaphragm 850 also includes a slack portion 858 that extends from the wear ring to portion 848 and is clamped to portion 848. The slack portion can be formed of a material having a low stiffness modulus or, alternatively, as illustrated, can be formed having a slack, bowed form. As such, the slack portion is configured so as not to make a moment contribution to the forces acting on the wear ring. Portion 848 of the rigid carrier plate or the extension thereof and diaphragm 850 thus enclose a cavity 860 within which the pressure can be controlled. Controlling the pressure in the cavity controls the height of wear ring 828. A frictional force exerted on wear ring 828 by the motion of polishing pad 838 relative to the wear ring can be represented by a friction force vector 862. Because of the resilient coupling of the wear ring by the conical diaphragm having a center at the lower surface of the work piece, the wear ring reaction force represented by wear ring reaction force vector 864 is collinear with friction force vector 862. Because the two forces are collinear, no overturning moment acts on the wear ring as a result of the frictional force, the pressure distribution of the wear ring against the polishing pad remains uniform about the circumference of the wear ring, and no slow band is observed during a polishing operation.

Thus it is apparent that there has been provided, in accordance with the invention, a work piece carrier head that fully meets the needs set forth above. The carrier head and the associated zero overturning moment wear ring have been disclosed and discussed with reference to various illustrative embodiments. It is not intended, however, that the invention be limited to these illustrative embodiments. The invention and several of its embodiments have been described with reference to the chemical mechanical planarization (CMP) of semiconductor wafers, but the invention is not limited to carrier heads for such applications. Reference in the description has been to "upper" and "lower" surfaces; these terms have been used only to aid in describing the invention and are not intended to be construed to be limiting. In each of the illustrated embodiments, the wear ring can be formed of any chemically inert, wear resistant material such as polyetheretherketone (PEEK), polyethylene terephthlate (PET), ceramics or other similar material. Those of skill in the art will recognized that many variations and modifications are possible without departing from the true scope of the invention. Accordingly, it is intended to include within the invention all such variations and modifications as fall within the scope of the claims.

What is claimed is:

1. A carrier head for an apparatus that polishes a surface of a work piece by pressing the work piece surface against a polishing pad, the carrier head comprising:

a rigid carrier plate;

a flexible work piece carrier membrane connected to the rigid carrier plate and against which a work piece can be positioned for polishing;

an annular wear ring resiliently coupled to the rigid carrier plate, the annular wear ring having a wear ring surface constrained to be maintained in a plane substantially parallel to the plane of the surface of the work piece during the polishing of the work piece surface; and a gimbal mechanism coupled to the rigid carrier plate and to the annular wear ring to provide the resilient coupling, the gimbal mechanism comprising a pivot point about which the annular wear ring can pivot, the pivot point located in a plane substantially coplanar with the wear ring surface.

2. The carrier bead of claim 1 wherein the wear ring coupling is independent of the flexible work piece carrier membrane.

3. The carrier head of claim 1 wherein the annular wear ring comprises a wear ring assembly having a bottom surface comprising the wear ring surface and an upper surface bounding one side of an interior chamber.

4. The carrier head of claim 3 further comprising an inflatable flexible bladder positioned within the interior chamber and configured to press against the upper surface to control the vertical position of the wear ring assembly.

5. The carrier head of claim 4 further comprising a channel formed in the rigid carrier plate within which the wear ring assembly can move in the vertical direction.

6. The carrier head of claim 1 wherein the pivot point comprises a virtual pivot centered at the center of the work piece.

7. The carrier head of claim 6 wherein the gimbal mechanism comprises a wear ring backing plate coupled to the wear ring and having a spherical surface, the spherical surface having a radius centered at the center of the work piece.

8. A carrier head for an apparatus that polishes a surface of a work piece by pressing the work piece surface against a polishing pad, the carrier head comprising:

a rigid carrier plate;

a flexible work piece carrier membrane connected to the rigid carrier plate and against which a work piece can be positioned for polishing; and an annular wear ring resiliently coupled to the rigid carrier plate by a suspension system comprising a conical diaphragm having a virtual pivot centered at a center of the work piece, the conical diaphragm further comprising a pressure slack portion, the annular wear ring having a wear ring surface constrained to be maintained in a plane substantially parallel to the plane of the surface of the work piece during the polishing of the work piece surface.

9. The carrier head of claim 8 wherein the wear ring is coupled to the rigid carrier plate by a suspension system comprising a virtual pivot centered substantially at the wear ring surface.

10. A carrier head for an apparatus that polishes a surface of a work piece by pressing the work piece surface against a polishing pad, the carrier head comprising:

a rigid carrier plate;

a flexible work piece carrier membrane connected to the rigid carrier plate and against which a work piece can be positioned for polishing;

an annular wear ring positioned to surround the work piece and to contact the polishing pad during the polishing of the work piece; and a gimbal mechanism resiliently suspending the annular wear ring from the rigid carrier plate such that a reaction force applied to date annual wear ring by the gimbal mechanism has a component substantially collinear with and opposite to a friction force exerted on the annular wear ring by the polishing pad during the polishing so that substantially no overturning moment is applied to the annular wear ring.

11. The carrier head of claim 10 wherein the gimbal mechanism comprises a resilient suspension system having a point of resiliency lying in a plane substantially coplanar with the work piece surface.

12. The carrier head of claim 11 wherein the gimbal mechanism comprises a flexible diaphragm having a planar portion positioned substantially in the plane of the work piece surface.

13. The carrier head of claim 12 further comprising a plate coupled to the wear ring and having a surface in contact with the planar portion.

14. The carrier head of claim 10 wherein the gimbal mechanism comprises a resilient suspension system having a virtual pivot centered at the center of the work piece.

15. The carrier head of claim 14 wherein the gimbal mechanism comprises a work piece centric gimbal.

16. The carrier head of claim 14 wherein the gimbal mechanism comprises a conical diaphragm centered at the center of the work piece.

17. The carrier head of claim 10 wherein the gimbal mechanism comprises:

a first spherical surface coupled to the wear ring and having a radius centered at the center of the work piece surface; and a second spherical surface coupled to the rigid carrier plate and mating with the first spherical surface.

18. The carrier head of claim 17 wherein the gimbal mechanism further comprises:

a plurality of ball races in each of the first and second spherical surfaces; and a ball bearing in each of the ball races.

19. A carrier head for an apparatus that polishes a surface of a work piece by pressing the work piece surface against a polishing pad, the carrier head comprising:

a rigid carrier plate;

a flexible work piece carrier membrane connected to the rigid carrier plate and against which a work piece can be positioned for polishing;

an annular wear ring positioned to surround the work piece and to contact the polishing pad during the polishing of the work piece;

a resilient coupling joining the annular wear ring to the rigid carrier plate and configured to maintain a surface of the wear ring in a plane substantially parallel to the plane of the work piece surface, the resilient coupling comprising:

a first spherical surface coupled to the wear ring and having a radius centered at a center of the wear ring surface; and a second spherical surface coupled to the rigid carrier plate and mating with the first spherical surface.

20. A carrier head for an apparatus that polishes a surface of a work piece by pressing the work piece surface against a moving polishing pad, the carrier head comprising:

a rigid carrier plate;

a flexible work piece carrier membrane connected to the rigid carrier plate and against which a work piece can be positioned for polishing; and an annular wear ring positioned to surround the work piece and to contact the polishing pad and to be acted upon by a frictional force exerted by the polishing pad during polishing, the annular wear ring resiliently coupled to the rigid carrier plate by a mechanical gimbal that applies a reaction force to the annular wear ring, the reaction force having a component in a direction collinear with and opposite to the frictional force to cause the frictional force to exert a substantially zero overturning moment on the annular wear ring.

21. The carrier head of claim 20 wherein the mechanical gimbal that applies a reaction force and the reaction force projects through an origin at the center of the work piece.

22. A carrier head for an apparatus which polishes a surface of a work piece by pressing the work piece surface against a moving polishing pad, the carrier head comprising:

a rigid carrier plate;

a flexible work piece carrier membrane connected to the rigid carrier plate and defining a work piece location;

an annular wear ring configured to surround the work piece location and to contact the polishing pad and to be acted upon by a friction force exerted by the polishing pad during polishing; and a gimbal mechanism joining the annular wear ring to the rigid carrier plate, the gimbal mechanism configured to exert a reaction force on the annular wear ring, the reaction force having a component in a direction intersecting the friction force to impart a substantially zero overturning moment on the annular wear ring.

23. A carrier head for an apparatus that polishes a surface of a work piece by pressing the work piece surface against a moving polishing pad, the carrier head comprising:

a rigid carrier plate configured to define a work piece location having a center;

an annular wear ring positioned to surround the work piece location; and a mechanical gimbal mechanism joining the annular wear ring to the rigid carrier plate and configured to exert a reaction force on the annular wear ring in response to any friction force exerted on the annular wear ring by the moving polishing pad to provide a virtual pivot point for the wear ring, the virtual pivot point positioned at the center of the work piece location so that the reaction force is oppositely directed to the friction force so that substantially no overturning moment is applied to the annular wear ring.

24. A carrier head for an apparatus that polishes a surface of a work piece by pressing the work piece surface against a polishing pad, the carrier head comprising:

a rigid carrier plate;

a flexible work piece carrier membrane connected to the rigid carrier plate and against which a work piece can be positioned for polishing;

an annular wear ring positioned to surround the work piece during polishing and to press against the polishing pad; and a resilient gimbal mechanism joining the annular wear ring to the rigid carrier plate, the resilient gimbal mechanism configured to exert a reaction force on the annular wear ring in response to any frictional force exerted on the annular wear ring by the polishing pad, the reaction force having a component positioned in a plane substantially coplanar with the frictional force to impart substantially no overturning moment to the annular wear ring.

* * * * *

UNITED STATES PATENT AND TRADEMARK OFFICE

CERTIFICATE OF CORRECTION

PATENT NO. : 6,540,592 B1
DATED : April 1, 2003
INVENTOR(S) : Stephen C. Schultz et al.

It is certified that error appears in the above-identified patent and that said Letters Patent is hereby corrected as shown below:

Column 12,
Line 51, delete “bead” and add -- head --.

Column 13,
Line 38, delete “date” and add -- the --.

Signed and Sealed this

Fifth Day of August, 2003

JAMES E. ROGAN
*Director of the United States Patent and Trademark Office*